United States Patent [19]

Peoples et al.

[11] Patent Number: 4,864,265

[45] Date of Patent: Sep. 5, 1989

[54] TRANSIENT SUPPRESSING POWER TRANSFORMER

[75] Inventors: Stuart A. Peoples, LaGrange; John Nay, Goldsboro, both of N.C.

[73] Assignee: General Signal Corporation, Stamford, Conn.

[21] Appl. No.: 264,130

[22] Filed: Oct. 28, 1988

[51] Int. Cl.[4] ..... H01F 33/00; H01F 15/04

[52] U.S. Cl. ..... 336/5; 336/69; 336/84 C

[58] Field of Search ..... 336/69, 70, 84 R, 84 C, 336/5, 100

[56] References Cited

U.S. PATENT DOCUMENTS 1,837,245 12/1931 Wheeler ..... 336/84 C

*Primary Examiner*—Thomas J. Kozma

*Attorney, Agent, or Firm*—R. Reichman; Robert S. Smith

[57] ABSTRACT

A transformer includes first and second coils which are generally cylindrical and having an outer circumferential surface, an inner diametral surface and first and second axial extremities. Shielding is disposed around the coils comprising a web shaped metallic, non-magnetic, electrically conductive generally rectangular first member. The first member has a first portion extending about substantially the entire inner diametral surface of the coils and has a plurality of tab shaped portions extending respectively about a substantial portion of each of said first and second axial extremities. A second non-magnetic, electrically conductive metallic member extending over substantially the entire circumferential extent of each coil.

26 Claims, 1 Drawing Sheet

TRANSIENT SUPPRESSING POWER TRANSFORMER

BACKGROUND OF THE INVENTION

The invention relates to transformers and particularly to common mode noise attenuation in transformers. While the invention has particular application to three phase transformers, we understood that the basic principles may also be applied to single phase transformers. The basic transformer has current in the primary that develops a fluctuating magnetic field. The field cuts the turns of the secondary to develop an electromotive force in the secondary. In addition to the desired electromotive force, other components that are not desired also pass over from the primary to the secondary as well as from the secondary to the primary. These undesired components are called noise. For many applications the noise is not objectionable. For many other applications the noise is objectionable and such applications include power supplies for computers and other data processing equipment, medical equipment and other voltage sensitive devices. Problems that may be encountered when such noise is transmitted may include the loss or change of data held in volatile memory or interference with electronic control equipment. For example, noise from a power line may introduce spurious signals into a computer operating system and these signals can be processed as significant data which may result in extra or missing bits which can drastically change the results. Similarly, an important factor is that certain rotating equipment, for example, may impose noise on the power line and this noise may affect other equipment that is connected to that line. Thus it is desirable to minimize both noise transferred from the primary to the secondary of the transformer, as well as from the secondary to the primary.

The prior art includes two known methods to achieve high common mode attenuation. The first involves spiral wrapping a coil in a manner similar to a "tire-wrap" using a conductive foil tape. The second uses a shield of relatively thick rigid conductor preformed by a machine into a box-like configuration which slides over the pre-insulated coil. Better attenuation is achieved by the first method because the preformed shield is arranged in closer proximity to the coil conductors. The spiral method is, however, undesirable because it is highly labor intensive. The box-like configuration is undesirable because it requires precise dimensioning and tooling, and the shield must be manufactured prior to assembly of the transformer.

The Faraday shield is well known and has been widely used. Applications include the use of a conductive foil placed between coils of the transformer to divert noise to ground. In some cases, capacitance around such a Faraday shield will still couple enough noise from the primary to the secondary to cause problems in very sensitive equipment. It is also known to use variations of the Faraday shield which is essentially a box shield which completely encloses the winding with a conductive foil. The box shield provides a ground path for primary circuit noise and has the advantage that a much smaller capacitance exists between primary and secondary coils than in the case of a simple Faraday shield.

The prior art has used various stamped metallic members which are intended to fit around at least some of the windings of a transformer. In some cases the shielding that has been employed obstructs the air flow or cooling liquid flow around the various coils in a manner that is detrimental to the life of the transformer.

The prior art includes the structures shown in the following U.S. Pat. Nos.: 2,978,658 Reaves; 3,983,522 Gearhart; 2,997,647 Gaugler et al; 4,236,133 Seiersen; 3,181,096 Raub; 4,311,977 Owen; 3,717,808 Horna; 4,454,492 Thackray; 3,886,434 Schreiner; 4,554,523 Miki et al; 3,982,814 Kaisrswerth et al; 4,571,570 Wiki et al; 3,278,877 Kameya et al; 3,560,902 Okuyama; 3,678,428 Morris et al; 3,699,488 Goodman et al; 4,042,900 Hinton et al; 4,153,891 McNutt; 4,518,941 Harada.

Of these listed Patents,.S. Pat. No. 4,042,900 Hinton et al, describes a floating electrostatic shield for disc windings. U.S. Pat. No. 3,699,488 Goodman et al, describes a static shield for each winding section which comprise a strip of aluminum-backed crepe paper. U.S. Pat. No. 4,153,891 McNutt, describes an electrostatic shield assembly for power transformer winding. Similarly, U.S. Pat. No. 4,518,941 Harada, describes two electrostatic shield foils imposed between the primary and secondary windings with an insulator disposed between the electrostatic shield foils. The other patents are only of general interest.

Some shield constructions have employed a discrete end cap for the coils, and these discrete end caps have required separate grinding wires to achieve optimum results and which thus require additional labor and materials to install.

It is an object of the invention to provide effective common-mode noise attenuation.

It is an object of the invention to provide apparatus which is inexpensive to manufacture as well as requires a minimum of labor to install.

Still another of the invention is to provide apparatus which does not obstruct cooling fluid flow (either air or oil or other fluid) adjacent to the side surfaces of the shield.

Yet another object of the invention is to provide a shield apparatus which has end caps which are integral part of the shield and thus do not require additional grounding wires for the end caps.

SUMMARY OF THE INVENTION

It has now been found that these and other objects of the invention may be attained in a transformer apparatus which may comprise a core, first and second coils which are each magnetically coupled to the core, each coil is generally cylindrical and has an outer circumferential surface, an inner diametral surface and first and second axial extremities; and shielding is disposed around at least the first coil comprising a web shaped metallic, non-magnetic, electrically conductive generally rectangular first member. The first member has a first portion extending about substantially the entire inner diametral surface of the one coil and the first member further includes a plurality of tab shaped portions extending respectively about a substantial portion of each of the first and second axial extremities.

In some forms of the invention both the primary and secondary windings have substantially identical shielding arrangements.

In some forms of the invention each of the plurality of tab shaped portions are defined by slits in the first member. Each of the tabs may be substantially rectangular. The first member may include four tabs extending over the first axial extremity and four additional tabs extending over the second axial extremity. The first coil may have a plurality of substantially planar faces, and the plurality of substantially planar faces intersect substantially along a plurality of lines. The first member may be dimensioned and configured with each of the slits being generally disposed proximate to one of the lines.

In other forms of the invention a second non-magnetic, electrically conductive metallic member extends over substantially the entire circumferential extent of the first coil. A non-magnetic, electrically conductive metallic wedge shaped member may be disposed proximate to a plurality of the slits.

Each of the members may be copper that is no greater than about 15 mils thick. The transformer apparatus may be a three phase transformer having first and second coils for each phase. Each of the first and second coils may be disposed in coaxial concentric relationship with a portion of the core. The first member may extend circumferentially around the coil starting at one of the generally planar faces and extends less than a full 360 degrees about the first coil to provide a gap intermediate the ends of the first member. Alternatively, the first member extends more than 360 degrees around the one coil and portions thereof overlap, all portions of the member that overlap are separated by insulation.

BRIEF DESCRIPTION OF THE DRAWING

The invention will be better understood by reference to the accompanying drawing in which.

DESCRIPTION OF THE PREFERRED EMBODIMENT

Referring to FIGS. 1–4, there is shown a transformer 10 which in the preferred embodiment is a three phase transformer having three primary and secondary coil assemblies 12, 14, 16. These coils assemblies 12, 14, 16 are disposed on respective legs of a core 18. In the conventional manner the primary and secondary windings are magnetically coupled to the core 18.

Figure 1:
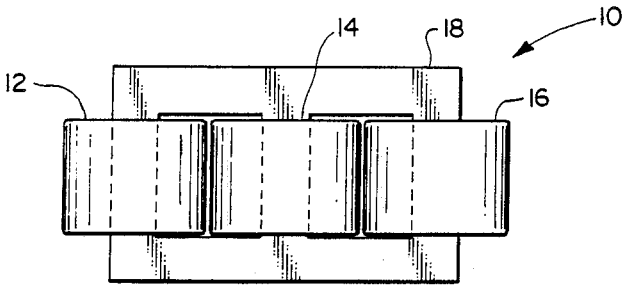
FIG. 1 is a partially schematic view of a three phase transformer in accordance with one form of the invention.
Figure 2:
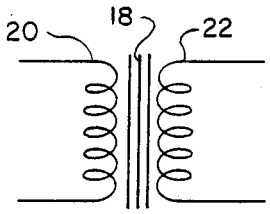
FIG. 2 is a schematic view of a transformer core, primary and secondary windings.
Figure 4:
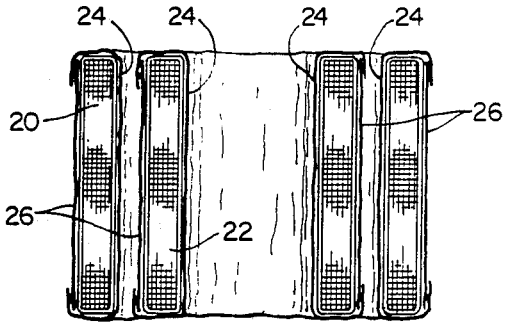
FIG. 4 is a second view taken along the Line 4—4 of FIG. 3.
Figure 3:
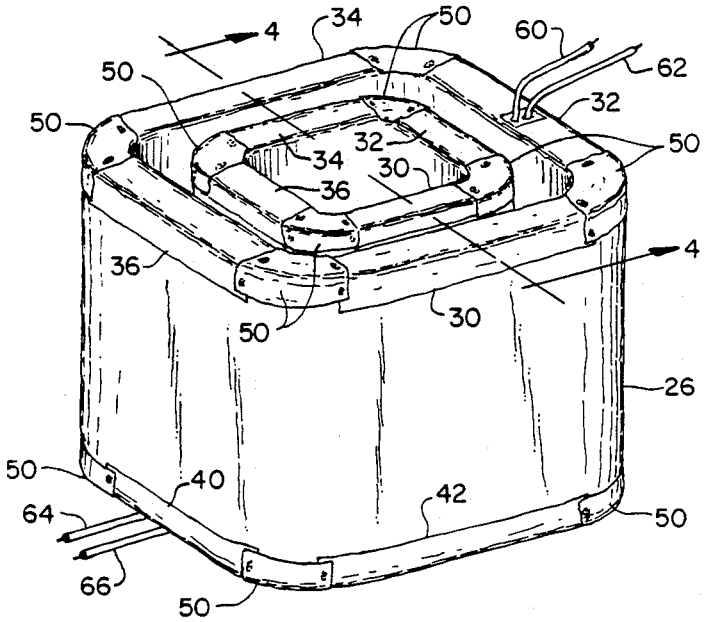
FIG. 3 is a partially schematic perspective view of primary and secondary coils for a single phase of the transformer shown in FIG. 1.

As best seen in FIGS. 3 and 4, each primary winding 20 is disposed in coaxial concentric relationship with a secondary winding 22. The windings 20, 22 ordinarily will be separated by a spacer (not shown) which has been omitted from the drawing to improve clarity. Each winding is covered by a first member which extends over substantially the entire inner diametral surface of the respective coils or windings 20, 22. The first member 24 overlaps the first and second axial extremity of each winding or coil 20, 22 and more specifically overlaps a second member 26 which covers substantially the entire outer circumferential surface of each winding or coil 20, 22. The first member 24 overlaps the axial extremities of the respective coil or winding 20, 22 as best shown in FIG. 4. More particularly, as best seen in FIG. 3, the first member 24 includes slits that divide the upper and lower (as viewed) extremities thereof into tab shaped elements identified by the reference numerals 30, 32, 34, 36 at the upper axial extremity of the coils or windings 20, 22. In a corresponding manner tabs formed in the first member 24 extend around the lower axial extremity of the windings 20, 22. Two such tabs 40, 42 are visible in FIG. 3. Those skilled in the art will recognize that the tabs formed by slits in the member 24 will not cover the corners of the generally rectangular coils 20, 22. Accordingly, the corners of each coil 20, 22 is provided with a wedged shaped member 50 that will be brazed to the adjacent tabs. More specifically, each wedged shaped member 50 will be brazed ordinarily to either tabs 34 and 36, or tabs 36 and 30, or 30 and 32, or tabs 32 and 34.

It will be understood that for simplicity the description of the primary and secondary windings and the reference numerals used have been identical even though the size of the respective coils will be understood to be different. Other than the obvious difference in size and number of turns, the coils are otherwise similar in construction.

The coils 20, 22 will ordinarily each have at least one layer of Nomex (a DuPont trademark) aramid insulation under the shield in accordance with the present invention. The insulation 27 is shown in FIG. 4. Accordingly, it is essential to only spot braze the wedged shaped members 50 to the adjacent tabs and to cool the structure immediately after the braze has been accomplished to minimize any damage to the insulation.

The windings 20, 22 shown in the drawing have been shown as generally rectangular or more particularly square windings. It will be understood by those skilled in the art that in various forms of the invention the windings 20, 22 may approach a cross section which is generally round or some other polygon form. The term "generally cylindrical" will be used herein to refer to all such forms. In other words, the term "generally cylindrical" will refer to a form which is generally in the form of a closed channel-shaped member having a hollow bore in the center.

To avoid a shorted turn the apparatus in accordance with the present invention will have a gap in the shield. The gap may be either axial or radial. More specifically, the member 26 may extend completely around the circumferential extent of the winding 20, 22 and may have insulation separating the overlapping portions of the second member 26. Similarly, the first member may have overlapping portions which are separated at the overlapping portion by insulation. For example, the insulation may be three layers of aramid insulation each having a thickness of 10 mils.

The shielding for each winding 20, 22 will be grounded. Spaces are provided in the tab 32 on the upper axial extremity of the winding 24 for exit of primary leads 60, 62 and in the tab 40 on the lower axial extremity of the winding 22 for exit of the secondary leads 64, 66.

The invention has application to a large range of transformer sizes. In the preferred embodiment the coils 20, 22 have a height of approximately 10" and a first member 24 extends generally vertically (as viewed) and an additional 2" at both the top and bottom thereof to overlap the axial extremities of the respective coils. [1]In other forms of the invention the first and second members merely extend vertically, as viewed, beyond the axial exterminties of the respective coils 20, 22 and are joined in face to face contact. Typically, the shield will be manufactured of a non-magnetic, electrically conductive metallic material such as copper, aluminum, or tin. In the preferred embodiment the material is copper having a thickness of about 9 mils. Ordinarily, the material will have a thickness of 15 mils or less. Because the material of the shield 18 is relatively easy to work with, there are substantial advantages in terms of ease of installation of the shielding in accordance with the invention.

Having thus described my invention we claim:

1. A transformer apparatus which comprises:

a core;

first and second coils which are each magnetically coupled to said core, each coil being generally cylindrical and having an outer circumferential surface, an inner diametral surface and first and second axial extremities; and shielding disposed around at least said first coil comprising a web shaped metallic, non-magnetic, electrically conductive generally rectangular first member, said first member having a first portion extending about substantially the entire inner diametral surface of said one coil, said first member further including a plurality of tab shaped portions extending respectively about a substantial portion of each of said first and second axial extremities.

2. The apparatus as described in claim 1 wherein:

each of said plurality of tab shaped portions are defined by slits in said first member.

3. The apparatus as described in claim 2 wherein:

each of said tabs are substantially rectangular.

4. The apparatus as described in claim 3 wherein:

said first member includes four tabs extending over said first axial extremity and four additional tabs extending over said second axial extremity.

5. The apparatus as described in claim 4 wherein:

said first coil has a plurality of substantially planar faces, said plurality of substantially planar faces intersect substantially along a plurality of lines, said first member being dimensioned and configured with each of said slits being generally disposed proximate to one of said lines.

6. The apparatus as described in claim 5 further including:

a second non-magnetic, electrically conductive metallic member extending over substantially the entire circumferential extent of said first coil.

7. The apparatus as described in claim 6 further including:

non-magnetic, electrically conductive metallic wedge shaped members disposed proximate to a plurality of said slits.

8. The apparatus as described in claim 7 wherein:

each of said members is copper.

9. The apparatus as described in claim 8 wherein:

each of said members is no greater than about 15 mils thick.

10. The apparatus as described in claim 9 wherein:

said transformer apparatus is a three phase transformer having first and second coils for each phase.

11. The apparatus as described in claim 10 wherein:

each of said first and second coils are disposed in coaxial concentric relationship with a portion of said core.

12. The apparatus as described in claim 11 wherein:

said first member extends circumferentially around said coil starting at one of said generally planar faces and extends less than a full 360 degrees about said first coil to provide a gap intermediate the ends of said first member.

13. The apparatus as described in claim 11 wherein:

said first member extends more than 360 degrees around said one coil and portions thereof overlap, all portions of said member that overlap being separated by insulation.

14. A transformer apparatus which comprises:

a core;

first and second coils which are each magnetically coupled to said core, each coil being generally cylindrical and having an outer circumferential surface, an inner diametral surface and first and second axial extremities; and shielding disposed around each of said coils comprising a web shaped metallic, nonmagnetic, electrically conductive generally rectangular first member, said first member having a first portion extending about substantially the entire inner diametral surface of said one coil, said first member further including a plurality of tab shaped portions extending respectively about a substantial portion of each of said first and second axial extremities.

15. The apparatus as described in claim 14 wherein:

each of said plurality of tab shaped portions are defined by slits in said first member.

16. The apparatus as described in claim 15 wherein:

each of said tabs are substantially rectangular.

17. The apparatus as described in claim 16 wherein:

said first member includes four tabs extending over said first axial extremity and four additional tabs extending over said second axial extremity.

18. The apparatus as described in claim 17 wherein:

said first coil has a plurality of substantially planar faces, said plurality of substantially planar faces intersect substantially along a plurality of lines, said first member being dimensioned and configured with each of said slits being generally disposed proximate to one of said lines.

19. The apparatus as described in claim 18 further including:

a second non-magnetic, electrically conductive metallic member extending over substantially the entire circumferential extent of each of said coils.

20. The apparatus as described in claim 19 further including:

non-magnetic, electrically conductive metallic wedge shaped members disposed proximate to a plurality of said slits.

21. The apparatus as described in claim 19 wherein:

each of said members is copper.

22. The apparatus as described in claim 21 wherein:

each of said members is no greater than about 15 mils thick.

23. The apparatus as described in claim 22 wherein:

said transformer apparatus is a three phase transformer having first and second coils for each phase.

24. The apparatus as described in claim 23 wherein:

each of said first and second coils are disposed in coaxial concentric relationship with a portion of said core.

25. The apparatus as described in claim 24 wherein:

said first member extends circumferentially around said coil starting at one of said generally planar faces and extends less than a full 360 degrees about said first coil to provide a gap intermediate the ends of said first member.

26. The apparatus as described in claim 24 wherein:

said first member extends more than 360 degrees around said one coil and portions thereof overlap, all portions of said member that overlap being separated by insulation.

* * * * *